US005553697A

United States Patent [19]

McClement

[11] Patent Number: 5,553,697

[45] Date of Patent: Sep. 10, 1996

[54] OVERLAY FOR A PASSENGER CONVEYOR ROLLER TRACK

[75] Inventor: Arthur McClement, Bloomington, Ind.

[73] Assignec: Otis Elevator Company, Farmington, Conn.

[21] Appl. No.: 491,004

[22] Filed: Jun. 15, 1995

[51] Int. Cl.[6] ..... B66B 23/12

[52] U.S. Cl. ..... 198/332; 198/838

[58] Field of Search ..... 198/331, 326, 198/332, 838, 845

[56] References Cited

U.S. PATENT DOCUMENTS

| | | | |
|---|---|---|---|
| 3,530,799 | 9/1970 | Braun | 198/321 X |
| 3,834,513 | 9/1974 | Miura et al. | 198/332 |
| 4,064,986 | 12/1977 | Bertovich | 198/326 |
| 4,175,652 | 11/1979 | Satou et al. | 198/332 |
| 4,381,851 | 5/1983 | Kraft | 198/838 X |
| 4,576,276 | 3/1986 | Boltrek et al. | 198/332 |
| 4,635,783 | 1/1987 | Hofling | 198/321 |
| 4,805,763 | 2/1989 | Kitamura et al. | 198/332 |
| 5,137,135 | 8/1992 | Pietsch et al. | 198/332 |
| 5,325,955 | 6/1994 | Ahls et al. | 198/332 |

FOREIGN PATENT DOCUMENTS 7206316 8/1995 Japan .

*Primary Examiner*—D. Glenn Dayoan

[57] ABSTRACT

An overlay for a passenger conveyor roller track extends over the joints between segments to provide the engagement surface for the roller track. The overlay separates the engagement surface from the joints between adjacent segments to minimize vibration and improve the comfort of the ride. In one embodiment, an escalator includes a roller track having a support structure formed from multiple segments joined end to end and an overlay extending over the multiple segments. The overlay defines the engagement surface for the rollers engaged with the roller track.

21 Claims, 1 Drawing Sheet

OVERLAY FOR A PASSENGER CONVEYOR ROLLER TRACK

TECHNICAL FIELD

The present invention relates to passenger conveyors that travel along a guided path, and more particularly to roller tracks for such passenger conveyors.

BACKGROUND OF THE INVENTION

Passenger conveyors, such as escalators and moving walks, are well known as efficient and effective methods to transport people. Much of the recent development in passenger conveyors has focused on improving the comfort level of the passengers on the conveyance while at the same time minimizing the cost of the conveyance. A significant portion of the cost is the expenses related to maintaining the conveyance such that it continues to operate efficiently and effectively.

For escalators and moving walks, the basic system includes a plurality of sequentially connected steps (or pallets) that form an endless loop traveling along a guided path. Each of the steps is attached to a step chain (or pallet chain) that is engaged with a drive sprocket, which is itself connected to an electric motor. The step chain includes a plurality of rollers that roll along a roller track. The roller track guides the path of the rollers and provides support for the passenger loads on the steps. In addition, each of the steps of an escalator includes a trailer roller that rolls along a separate trailer roller track.

The roller tracks are typically made from formed steel shapes due to the durability of steel to withstand wear. To form the length of roller track desired, multiple segments of roller track are joined end to end. During operation of the escalator, the rollers engage these joints and may introduce vibration and discomfort into the ride. In addition, any long term wear or damage to the running surface requires costly repair or replacement of the damaged roller track segment.

The above art notwithstanding, scientists and engineers under the direction of Applicant's Assignee are working to develop roller tracks that optimize the comfort of the ride for the passengers and minimize the cost of producing and maintaining the passenger conveyor.

DISCLOSURE OF THE INVENTION

According to the present invention, an overlay for a roller track extends over a plurality of the segments forming the roller track and includes the engagement surface for the passenger conveyor.

An advantage of the overlay is a smoother ride for the passengers riding on the conveyor. The overlay covers the joints between segments and thereby eliminates the joints from the engagement surface between the passenger conveyor and the roller track. The engagement surface produced by using the overlay is a smooth, continuous surface without interruptions that may generate unwanted vibration in the passenger conveyor. Another advantage of the overlay is the ease and inexpensive manner in which the engagement surface may be replaced in the event of undue wear or damage. Only the overlay needs to be removed and replaced; the underlying structural segments of the roller track may be left in place. This minimizes or eliminates the requirement to realign the roller track.

In addition to the above cited benefits and advantages of the present invention, the material or materials from which the overlay is formed may be selected such that the overlay provides a damping layer between the rollers and the roller track. As a result, the damping layer may improve the comfort of the ride produced by the passenger conveyor.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
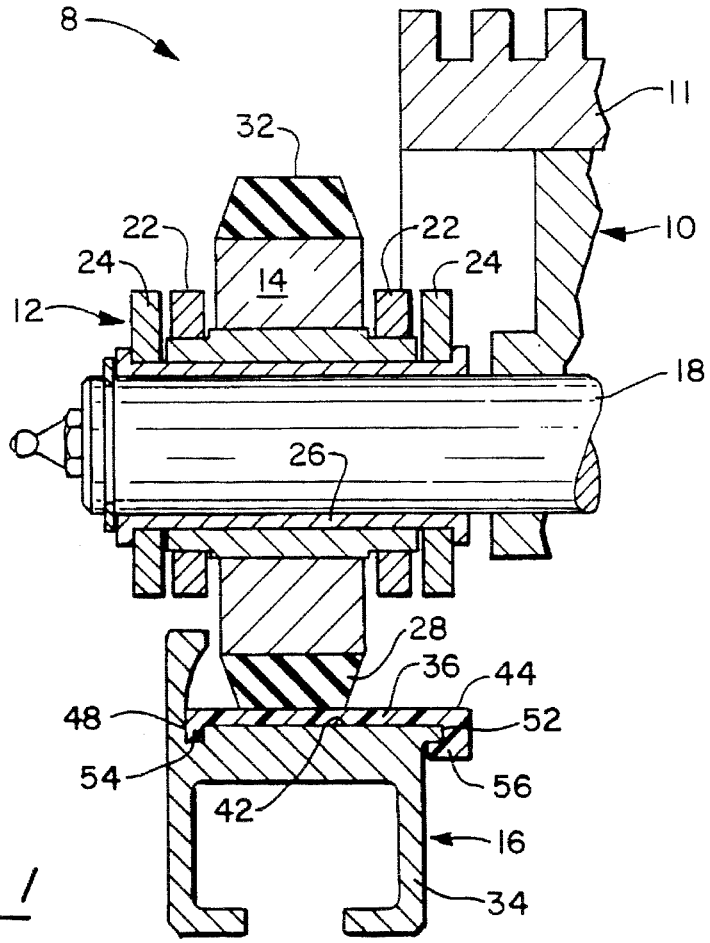
FIG. 1 is a passenger conveyor roller track having an overlay.
Figure 2:
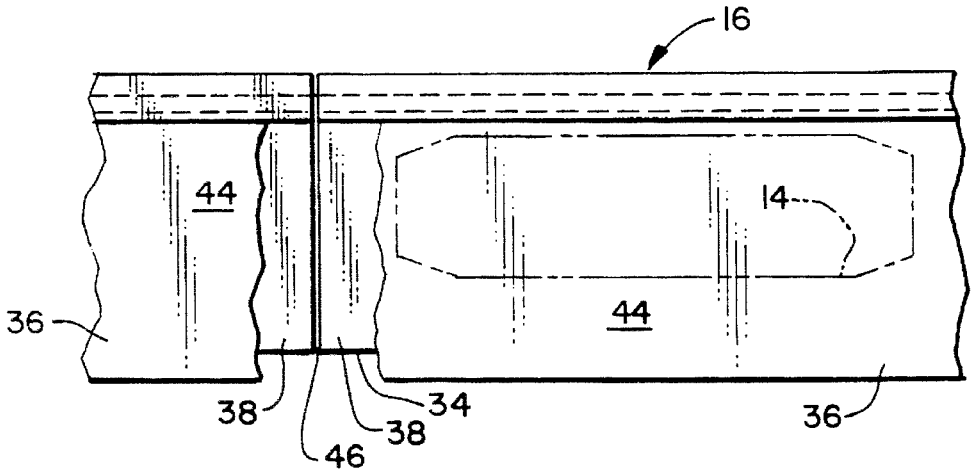
FIG. 2 is a top view of a section of the roller track, with the overlay partially cut-away to illustrate the joints between adjacent roller track segments.

One embodiment of the present invention is illustrated in FIGS. 1 and 2. A passenger conveyor 8 includes a step 10 having a treadplate 11 and a step chain 12. The treadplate 11 defines the platform for bearing passengers. The step chain 12 includes a roller 14 and a roller track 16. The roller 14 rotates about an axle 18. The step chain 12 further includes a pair of chain links 22,24, one 22 extending forward and the other 24 extending aft from the axle 18. Each of the chain links 22,24 attaches the roller 14 to the next adjacent roller along the step chain 12. The roller 14 and links 22,24 are engaged with a bushing 26 positioned on the axle 18.

The roller 14 includes an elastomeric tread 28 extending radially about the outer edge of the roller 14. The tread 28 provides the engagement surface 32 for rolling contact with the roller track 16.

The roller track 16 extends along the length of the passenger conveyor 12 and defines the path of travel of the steps 10. The roller track 16 includes a support structure 34 and an overlay 36. The support structure 34 is formed from a plurality of extruded segments 38 that are joined end to end to provide a frame for carrying the load of the step and passengers. The overlay 36 extends over the upper surface 42 of the support structure 34 to provide the engagement surface 44 of the roller track 16 for rolling contact with the tread 28 of the rollers 14.

As shown more clearly in FIG. 2, the plurality of segments 38 are mated together such that a joint 46 is produced therebetween. The overlay 36 extends over the plurality of segments 38 to separate the joints 46 from the engagement surface 44. In this way the rollers 14 do not engage the joints 46 as they roll over the roller track 16.

The support structure 34 includes a recess 48 and a ridge 52. The recess 48 is shaped to receive a hook 54 extending from one lateral side of the overlay 36. The ridge 52 is sized to be received within another hook 56 extending from the opposite lateral side of the overlay 36. The cooperation of the hooks 54,56 and the recess 48 and ridge 52 provides means to retain the overlay 36 to the support structure 34.

To install the overlay 36 onto the support structure 34, the hook 56 is engaged with the ridge 52 and then the overlay 36 is pivoted about the ridge 52 until the opposite hook 54 is proximate to the recess 48. The hook 54 is then forced into the recess 48 such that a snap-fit engagement is produced between the overlay 36 and the support structure 34. The installation may be performed progressively along the length of the support structure 34. It should be obvious to those skilled in the art that the overlay may be retained to the support structure in a variety of ways, such as by bonding directly to the support structure or by using fasteners. The hook type retention described provides the additional benefit of the overlay being easily removable and replaceable in the event that the engagement surface 44 becomes worn or damaged.

The segments of the support structure may be formed by extruding and/or roll forming a selected material into the desired shape and size. Since the support structure does not provide the engagement surface, materials lighter, and easier to form than the steel material traditionally used for roller tracks may be selected for the support structure. The selected material needs to provide the strength to support the steps and passenger loads, but is not required to provide the durability required of the contact surface. A suggested material for the support structure is aluminum.

The overlay should be formed from a material providing a wear resistant surface for the engagement surface. Suggested materials include ultra high molecular weight polyethylene (UHMW), polyetheretherketone (PEEK), or other high density plastics that have high bearing and wear characteristics. The suggested materials may be formed into the desired shape by extrusion and facilitate handling during installation, removal and replacement of the overlay. An additional benefit of the suggested materials for the overlay is that such materials provide a softer contact surface than steel and may provide some dampening of the contact between the rollers and the roller track to cushion the ride of the passengers.

The embodiments illustrated in FIGS. 1–2 show a single layer overlay extending over a roller track. The overlay may also be formed from multiple layers that extend over the roller track. In this way, the outermost layer may be optimized for durability to withstand the wearing contact with the rollers with an intermediate layer or layers optimized to provide other benefits, such as damping. In addition, the overlays of FIGS. 1–2 are shown and described as extending over the entire length of the support structure. In some applications this length of overlay may not be practical. In this instance, multiple overlays mated end to end may be used to extend over the total length of the support structure. Although this embodiment may introduce some joints between adjacent overlays, the number of joints will be reduced and the other benefits, such as ease of installation, removeability, and damping will still be realized.

Although the invention has been shown and described with respect to exemplary embodiments thereof, it should be understood by those skilled in the art that various changes, omissions, and additions may be made thereto, without departing from the spirit and scope of the invention.

What is claimed is:

1. An overlay for a roller track of a passenger conveyor, the passenger conveyor including a passenger bearing platform, the platform moving through a path defined by engagement between the platform and the roller track, the roller track including a plurality of segments joined sequentially to form a plurality of joints between adjacent segments, the overlay extending over the plurality of segments and joints, the overlay having an engagement surface for the platform.

2. The overlay according to claim 1, further including means to removably attach the overlay to the roller track.

3. The overlay according to claim 2, wherein the attachment means includes a hook engageable with the guide rail such that the overlay may be snap-fit onto the roller track.

4. The overlay according to claim 2, wherein the attachment means includes a first hook engageable with a ridge extending from the roller track and a second hook engageable with a recess in the roller track, the attachment means permitting the overlay to be snap-fit onto the roller track.

5. The overlay according to claim 1, wherein the overlay is formed from an polymer material.

6. The overlay according to claim 5, wherein the polymer material is an ultra-high molecular weight material.

7. The overlay according to claim 1, wherein the platform includes a plurality of rollers, and wherein the engagement surface defined by the overlay is in rolling contact with the plurality of rollers.

8. The overlay according to claim 7, wherein the platform is an escalator step having the plurality of rollers, and wherein the overlay extends over the roller track to define a rolling contact engagement surface for the plurality of rollers.

9. The overlay according to claim 7, wherein the platform is a moving walk pallet having the plurality of rollers, and wherein the overlay extends over the roller track to define a rolling contact engagement surface for the plurality of rollers.

10. A roller track for a passenger conveyor, the passenger conveyor including a plurality of sequentially connected platforms for bearing passengers, each of the platforms including a pair of rollers, the interconnected platforms moving through a path defined by engagement between the plurality of rollers and the roller track, the roller track including a plurality of segments and an overlay, the plurality of segments joined sequentially to form a plurality of joints between adjacent segments, the overlay extending over the plurality of segments and joints, the overlay having an engagement surface for the plurality of rollers.

11. The roller track according to claim 10, wherein the roller track further includes means to removable attach the overlay to one or more of the segments.

12. The roller track according to claim 11, wherein the attachment means includes a hook engageable with one or more of the segments such that the overlay may be snap-fit onto the segments.

13. The roller track according to claim 11, wherein the attachment means includes a first hook engageable with a ridge extending from one or more of the segments and a second hook engageable with a recess in the segments, the attachment means permitting the overlay to be snap-fit onto the segments.

14. The roller track according to claim 10, wherein the overlay is formed from an polymer material.

15. The roller track according to claim 14, wherein the polymer material is an ultra-high molecular weight material.

16. A method to install a roller track for a passenger conveyor, the passenger conveyor including a platform for bearing passengers, the platform moving through a path defined by engagement between the platform and the roller track, the roller track including a plurality of segments adapted to be joined sequentially and an overlay, the overlay having an engagement surface for the platform, the method including the steps of:

joining the plurality of segments sequentially, such that a plurality of joints between adjacent segments are thereby formed;

attaching the overlay to the plurality of joined segments, the overlay extending over the plurality of segments and joints.

17. The method according to claim 16, wherein the overlay includes a hook extending therefrom, wherein one or more of the segments includes a ridge having a shape complementary to the hook and adapted to engage the hook to retain the overlay to the plurality of segments, and wherein the step of attaching the overlay to the plurality of joined segments includes engaging the hook with the ridge.

18. The method according to claim 17, wherein the overlay includes a second hook extending therefrom, wherein the one or more of the plurality of segments further includes a second ridge having a shape complementary to the second hook and adapted to engage the second hook, and wherein the step of attaching the overlay to the plurality of joined segments includes urging the hooks into engagement with the complementary ridges such that the overlay is snap-fit onto the plurality of joined segments and retained by the engagement of the hooks and the ridges.

19. A method to replace the engagement surface for the engagement between a roller track of a passenger conveyor and a passenger beating platform of the passenger conveyor, the roller track including a plurality of segments adapted to be joined sequentially and a first overlay, the first overlay having the engagement surface for the platform and being removable attached to the plurality of joined segments, the method including the steps of:

removing the first overlay attached to the plurality of joined segments; and attaching a second overlay to the plurality of joined segments, the second overlay including the replacement engagement surface.

20. The method according to claim 19, wherein the overlays include a hook extending therefrom, wherein one or more of the segments includes a ridge having a shape complementary to the hooks and adapted to engage the hooks to retain the overlays to the plurality of segments, wherein the step of removing the first overlay includes disengaging the hook of the first overlay from the ridge, and wherein the step of attaching the second overlay to the plurality of joined segments includes engaging the hook with the ridge.

21. The method according to claim 20, wherein the overlays include a second hook extending therefrom, wherein the one or more of the plurality of segments further includes a second ridge having a shape complementary to the second hooks and adapted to engage the second hooks, and wherein the step of attaching the overlay to the plurality of joined segments includes urging the hooks into engagement with the complementary ridges such that the overlay is snap-fit onto the plurality of joined segments and retained by the engagement of the hooks and the ridges.

* * * * *